United States Patent [19]

Levine

[11] 4,237,767

[45] Dec. 9, 1980

[54] CHIME ASSEMBLY

[75] Inventor: David H. Levine, Tarzana, Calif.

[73] Assignee: Carroll Sound, Inc., New York, N.Y.

[21] Appl. No.: 21,040

[22] Filed: Mar. 16, 1979

[51] Int. Cl.[3] ..... G10D 13/08

[52] U.S. Cl. ..... 84/406; 116/169

[58] Field of Search ..... 84/103, 402–408; 368/273; 116/169

[56] References Cited

U.S. PATENT DOCUMENTS

| | | | |
|---|---|---|---|
| 878,387 | 2/1908 | Havassy | 84/406 |
| 4,154,135 | 5/1979 | Haack | 84/406 |

FOREIGN PATENT DOCUMENTS

| | | | |
|---|---|---|---|
| 18980 | of 1905 | United Kingdom | 116/169 |
| 6395 | of 1906 | United Kingdom | 116/169 |

*Primary Examiner*—Lawrence R. Franklin

*Attorney, Agent, or Firm*—Allison C. Collard; Thomas M. Galgano

[57] ABSTRACT

A chime assembly is provided which includes an elongated chime support bar, a multiplicity of chimes, suspended from the support bar, and a damper bar pivotably secured to the support bar. The damper bar is movable between an engaged and non-engaged position relative to the chimes suspended from the support bar so as to produce dampened and non-dampened sounds, respectively, upon one striking the chimes.

9 Claims, 6 Drawing Figures

CHIME ASSEMBLY

The present invention relates to a chime assembly as well as a dampening device for use in connection with a chime assembly. More particularly, it relates to a chime assembly, commonly referred to as a Mark Tree, which is provided with a damper bar to permit a dampened sound effect upon striking of the chimes.

Chime assemblies, commonly referred to as Mark Trees, are, of course, well known in the trade. Typically, they consist of a generally horizontally-disposed, support bar supported on a stand, from which are suspended a multiplicity of cylindrical chimes. While quite effective and useful, such Mark Trees have been found to be disadvantageous in that there is no provision for dampening the sound produced by the chimes. Furthermore, so far as is known, no presently-available Mark Tree is provided with a dampening device which is as simple and yet effective as herein proposed.

Accordingly, it is an object of the present invention to provide a novel chime assembly and a damper bar for such assembly which permits dampening of the sound of such chimes.

It is also an object of the present invention to provide such a chime assembly and damper bar which is simple in construction and operation and which may be economically produced.

It is a more particular object of the present invention to provide a chime assembly and damper bar having the foregoing attributes and characteristics which is reliable and dependable in operation.

Certain of the foregoing and related objects are readily attained in a chime assembly which includes an elongated chime support bar, a multiplicity of chimes, means for suspending the chimes from the support bar and a damper bar which is pivotably secured to the support bar. The damper bar is pivotably movable between an engaged and non-engaged position relative to the chimes suspended from the support bar so as to produce dampened and non-dampened sounds, respectively, upon striking of the chimes.

Preferably, the support bar includes an elongated, generally rectangular wooden bar and the chimes each comprise a metallic, tubular cylindrical rod. Most advantageous, the damper bar includes a generally U-shaped member having an elongated base wall and two upstanding side arms joined to opposite ends of the base wall, which sidearms each have an upper free end which is pivotably secured to an opposite end of the support bar. The base wall has secured thereto a sound dampening material which is disposed to contact the chimes when the damper bar is pivoted to the engaged position thereof relative to the chimes.

In a particularly preferred embodiment of the invention, each of the opposite ends of the support bar have a generally L-shaped clamp secured thereto. The free ends of each of the side arms of the damper bar is pivotably secured to one of these L-shaped clamps so as to permit the aforesaid pivotable movement thereof.

Most desirably, the sound dampening material secured to the base wall of the damper bar comprises a felt material.

Certain of the foregoing and related objects are also attained in a dampening device for use in combination with a chime assembly having an elongated chime support bar, a multiplicity of chimes and means for suspending the chimes from the support bar, which includes a damper bar pivotably securable to the support bar for movement between an engaged and non-engaged position relative to the chimes suspended from the support bar so as to produce dampened and non-dampened sounds, respectively, upon striking the chimes. The dampening device also includes means for pivotably securing the damper bar to the support bar.

Other objects and features of the present invention will become apparent from the following detailed description when taken in connection with the accompanying drawings which disclose one embodiment of the invention. It is to be understood that the drawings are designed for the purpose of illustration only, and are not intended to be a definition of the limits and scope of the invention.

In the drawings, wherein similar reference characters denote similar elements throughout the several views.

Figure 2:
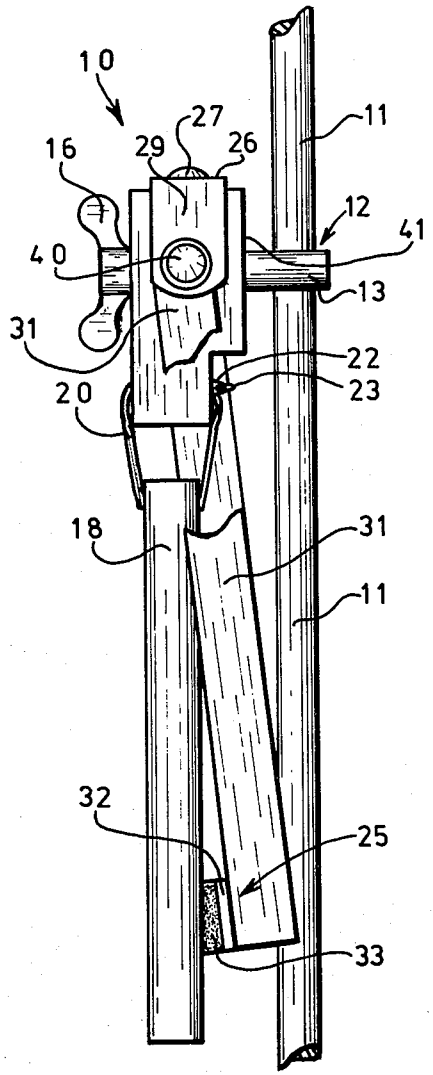
FIG. 2 is an enlarged, side-elevational view of the assembly shown in FIG. 1 with portions broken away to show internal construction and further showing the damper bar in an engaged position relative to the chimes.
Figure 1:
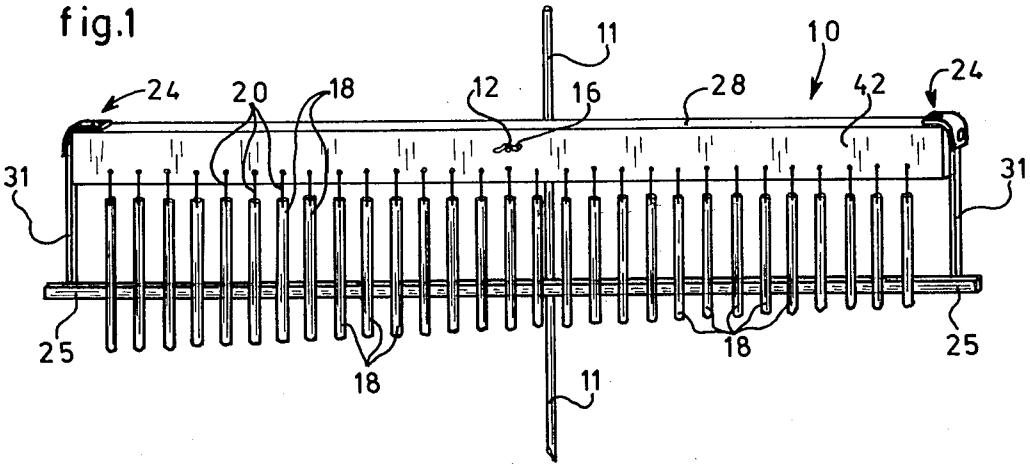
FIG. 1 is a perspective view of a chime assembly embodying the present invention.
Figure 3:
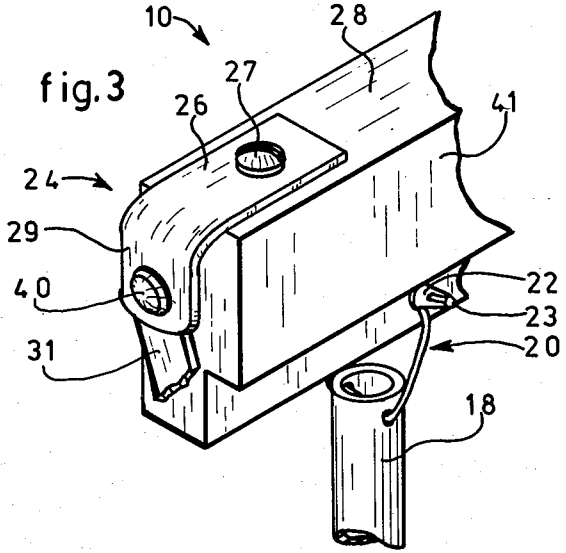
FIG. 3 is an enlarged, fragmentarily-illustrated, perspective view of a portion of the chime assembly shown in FIG. 1, illustrating the mounting of the chimes to the support bar.

Turning now in detail to the drawings and in particular, FIGS. 1–3 thereof, therein illustrated is a novel chime assembly embodying the present invention which includes a horizontally-disposed, elongated, generally rectangular support bar 10 which is mounted on the vertical post 11 of a cymbal stand by means of a nut and bolt assembly 12. Nut and bolt assembly 12 includes a threaded bolt 13 which is secured to (by means not shown) and which extends outwardly from the vertically-disposed post 11 of cymbal stand. As can be seen more clearly in FIG. 6, support bar 10 has a centrally-disposed, laterally-extending bore 14 formed therethrough which permits it to be received on the end of bolt 13 with its rear surface 41 held against a nut 15 threaded onto bolt 13 by means of a wing nut 16 also threaded on bolt 13 and pressing against its front surface 42.

As can been seen from FIG. 1, support bar 12 has a multiplicity of cylindrical metal chimes 18 suspended therefrom. As can be seen more clearly in FIG. 6, the chimes have a radial bore 19 extending through one end thereof through which a plastic wire loop support 20 is threaded. In a similar fashion, the plastic wire support 20 is also threaded through a lateral bore 21 provided in the support bar 10. One end of the plastic wire support is provided with a hollow, slotted cone-shaped locking member 22 through which the opposite end 23 which has an enlarged cone-shaped tip, is received so as to securely fasten the loop and afford adequate support for the suspended chime; as can be appreciated, the upper ends of the chimes could be supported by other conventional means. As can be seen in FIG. 1, the chimes are equally-spaced along the support bar 1 and each are provided with a different length so as to produce different tones.

As shown best in FIGS. 1–4, attached to the ends of the support bar 10 are two generally L-shaped clamps 24 which pivotably support a generally U-shaped damper bar 25. L-shaped clamps 24 each include a horizontally-disposed first arm 26 which is secured by means of a screw 27 to the top surface 28 of support bar 10 and a second, vertically-disposed arm 29 depending therefrom which extends downwardly over and spaced from the end of the support bar 10. The lower end of arm 29 has a bore extending therethrough in which is pivotably supported a bolt assembly 40 to which one of the side arms 31 of the U-shaped damper bar is rigidly secured.

Figure 5:
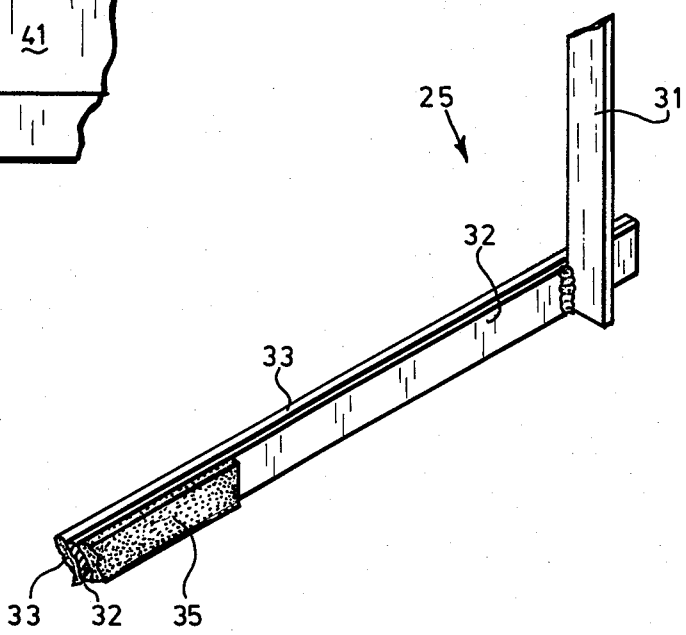
FIG. 5 is an enlarged, fragmentarily-illustrated, perspective view of the damper bar.
Figure 4:
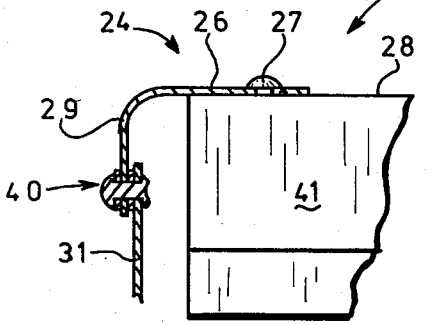
FIG. 4 is an enlarged, fragmentarily-illustrated, rear elevational view of a portion of the support bar and the pivotable attachment of one end of the damper bar thereto.

As can be seen more clearly in FIG. 5, each of the side arms 31 which consist of a flat metal bar are each secured along the lower edges thereof to a horizontally-disposed metal base wall 32 which also consists of a flat strip of metal. On the side of the base wall 32 facing the chimes (see FIGS. 2 and 6) base wall 32 has secured thereon a felt strip 33; it has a similar felt strip 35 on the rear side thereof in the center region thereof adjacent to the vertical post 11 of the stand.

Figure 6:
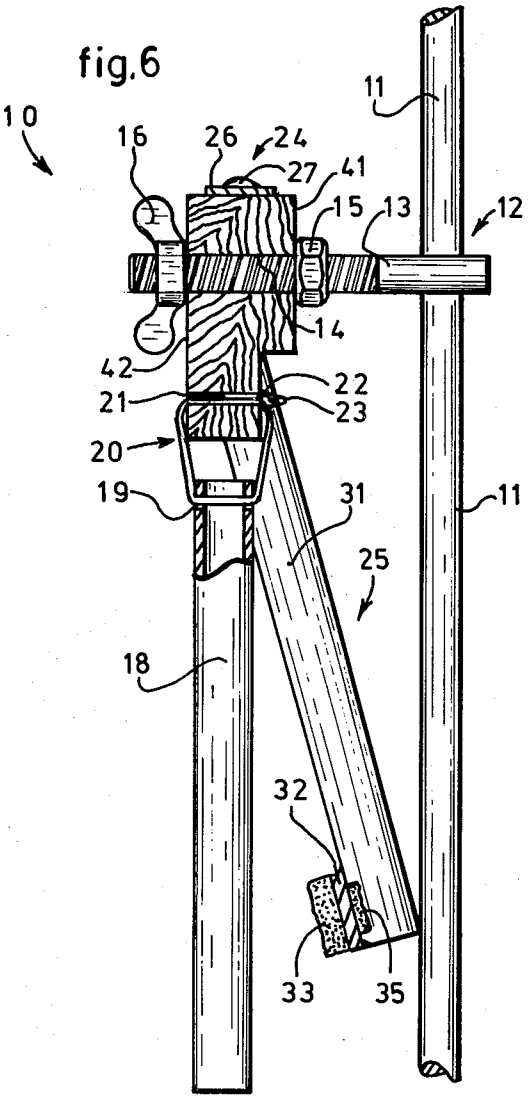
FIG. 6 is an enlarged, cross-sectional view, in part elevation, showing the damper bar in a non-engaged position relative to the chimes.

In operation, when it is desired to use the chime assembly in a non-dampened state, the damper bar is pivoted rearwardly and upwardly about the upper ends of its side arms 31 to the position shown in FIG. 6, in which position the damper bar is in a non-engaging position relative to the chimes, thereby permitting full vibrational movement thereof upon striking of the same with a mallot or some other striking instrument. However, when it is desired to dampen the sound of the chimes, the damper bar is pivoted about the upper ends of its sidearms 11 in a downwardly and forwardly-directed manner to the position shown in FIG. 2, in which position the felt material 33 affixed to the front side of base wall 32 is engaged with the rear surfaces of the chimes 18, thereby dampening the vibrational movement thereof when struck with the mallot. As can be appreciated, all that is necessary in effecting dampening and non-dampening is pivotal movement of the damper bar to and fro as indicated above; the damper bar maintaining the desired position solely as a result of the pivotable and, of course, frictional support provided by the bolt assembly 40.

While only one embodiment of the present invention has been shown and described, it will be obvious to those persons of ordinary skill in the art, that many changes and modifications may be made thereunto, without departing from the spirit and scope of the invention.

What is claimed is:

1. A chime assembly comprising:

an elongated chime support bar;

a multiplicity of chimes;

means for suspending said chimes from said support bar; and a manually movable damper bar including mounting means for pivotably and frictionally securing said damper bar to said support bar for movement between an engaged and non-engaged position relative to said chimes suspended from said support bar so as to produce dampened and non-dampened sounds, respectively, upon the striking of said chimes, said damper bar being held in the desired position solely by the frictional support provided by said mounting means.

2. The chime assembly according to claim 1, wherein said support bar comprises an elongated, generally rectangular wooden bar and wherein said chimes each comprise a metallic tubular rod.

3. The chime assembly according to claim 1, wherein said damper bar comprises a generally U-shaped member having an elongated base wall and two upstanding side arms joined to opposite ends of said base wall, said side arms each having an upper free end which is pivotably secured to an opposite end of said support bar and said base wall having secured to one side thereof a sound-dampening material which is disposed to contact said chimes when said damper bar is pivoted to said engaged position thereof relative to said chimes.

4. The chime assembly according to claim 3, wherein said opposite ends of said support bar each have a generally L-shaped clamp secured thereto, to each of which is pivotably secured the free end of one of said sidearms of said damper bar.

5. The chime assembly according to claim 3, wherein said sound-dampening material comprises felt.

6. A dampening device for use in combination with a chime assembly including an elongated chime support bar, a multiplicity of chimes and means for suspending the chimes from the support bar, comprising:

a manually movable damper bar including mounting means for pivotably and frictionally securing said damper bar to said support bar for movement between an engaged and non-engaged position relative to said chimes suspended from said support bar so as to produce dampened and non-dampened sounds, respectively, upon the striking of said chimes, said damper bar being held in the desired position solely by the frictional support provided by said mounting means.

7. The chime assembly according to claim 6, wherein said damper bar comprises a generally U-shaped member having an elongated base wall and two upstanding side arms joined to opposite ends of said base wall, said side arms each having an upper free end which is pivotably securable to an opposite end of said support bar and said base wall having secured to one side a sound-dampening material which is disposed to contact said chimes when said damper bar is pivoted to said engaged position thereof relative to said chimes.

8. The chime assembly according to claim 7, wherein said opposite ends of said support bar each have a generally L-shaped clamp secured thereto, to each of which is pivotably secured the free end of one of said side arms of said damper bar.

9. The chime assembly according to claim 8, wherein said sound-dampening material comprises felt.

* * * * *

Disclaimer 4,237,767.—*David H. Levine,* Tarzana, Calif. CHIME ASSEMBLY. Patent dated Dec. 9, 1980. Disclaimer filed Jan. 25, 1982, by the assignee, *Carroll Sound, Inc.*

Hereby enters this disclaimer to all claims of said patent.

[*Official Gazette March 23, 1982.*]